US010943730B2

(12) United States Patent
Luo et al.

(10) Patent No.: US 10,943,730 B2
(45) Date of Patent: Mar. 9, 2021

(54) SINGLE-ENDED INDUCTOR

(71) Applicant: Realtek Semiconductor Corp., Hsinchu (TW)

(72) Inventors: Cheng Wei Luo, Hsin Chu (TW); Hsiao-Tsung Yen, Hsin Chu (TW); Ta-Hsun Yeh, Hsin-Chu (TW); Yuh-Sheng Jean, Ta Pi Hsiang (TW)

(73) Assignee: Realtek Semiconductor Corp., Hsinchu (TW)

( * ) Notice: Subject to any disclaimer, the term of this patent is extended or adjusted under 35 U.S.C. 154(b) by 196 days.

(21) Appl. No.: 15/462,344

(22) Filed: Mar. 17, 2017

(65) Prior Publication Data

US 2017/0271076 A1 Sep. 21, 2017

(30) Foreign Application Priority Data

Mar. 18, 2016 (TW) ..... 105108391 A

(51) Int. Cl.

| | |
|---|---|
| ***H01F 5/04*** | (2006.01) |
| ***H01F 27/34*** | (2006.01) |
| ***H01F 17/00*** | (2006.01) |
| ***H01F 27/28*** | (2006.01) |

(52) U.S. Cl.

CPC ..... *H01F 27/346* (2013.01); *H01F 5/04* (2013.01); *H01F 17/0006* (2013.01); *H01F 27/28* (2013.01); *H01F 2017/0046* (2013.01); *H01F 2017/0073* (2013.01)

(58) Field of Classification Search

CPC ..... H01F 27/346; H01F 5/04; H01F 27/28; H01F 17/0006; H01F 2017/0073; H01F 2017/0046

See application file for complete search history.

(56) References Cited

U.S. PATENT DOCUMENTS

| | | | | |
|---|---|---|---|---|
| 6,194,987 | B1 * | 2/2001 | Zhou | H01L 23/5227 336/200 |
| 6,320,491 | B1 * | 11/2001 | Gevorgian | H01F 17/0006 336/200 |
| 6,894,598 | B2 * | 5/2005 | Heima | H01F 17/0013 257/E27.046 |
| 7,486,167 | B2 * | 2/2009 | Loke | H01L 23/5227 336/200 |
| 7,796,007 | B2 * | 9/2010 | Hopper | H01F 27/2804 336/200 |
| 8,183,971 | B2 | 5/2012 | Le Guillou et al. | |
| 8,305,182 | B1 | 11/2012 | Tsai et al. | |
| 8,581,684 | B2 * | 11/2013 | Noire | H01F 17/0013 336/200 |

(Continued)

FOREIGN PATENT DOCUMENTS

| | | | |
|---|---|---|---|
| JP | H0684647 | A | 3/1994 |
| TW | I410986 | B | 10/2013 |
| TW | 201546843 | A | 12/2015 |

*Primary Examiner* — Tuyen T Nguyen

(74) *Attorney, Agent, or Firm* — Muncy, Geissler, Olds & Lowe, P.C.

(57) ABSTRACT

A single-ended inductor comprises a first partial coil wound in a first direction; and a second partial coil wound in a second direction and adjoined the first partial coil; wherein, the second direction is opposite to the first direction to reduce the coupling of single-ended inductors and peripheral lines and reduce signal interference.

3 Claims, 10 Drawing Sheets

(56) References Cited

U.S. PATENT DOCUMENTS

| | | | | |
|---|---|---|---|---|
| 8,937,523 | B1 * | 1/2015 | Ho | H03F 3/211 336/200 |
| 2004/0217839 | A1 * | 11/2004 | Haaren | H01L 27/08 336/200 |
| 2008/0048816 | A1 * | 2/2008 | Matsumoto | H01F 19/04 336/200 |
| 2014/0077914 | A1 * | 3/2014 | Ohkubo | H01F 5/00 336/177 |
| 2015/0206634 | A1 * | 7/2015 | Yan et al. | H01F 5/003 |

* cited by examiner

300

400

600

700

SINGLE-ENDED INDUCTOR

This application claims priority of No. 105108391 filed in Taiwan R.O.C. on Mar. 18, 2016 under 35 USC 119, the entire content of which is hereby incorporated by reference.

BACKGROUND OF THE INVENTION

Field of the Invention

The invention relates to an inductor, and more particularly to a single-ended inductor of eliminating a coupling phenomenon with a peripheral wire line using a winding design.

Description of the Related Art

A coupling phenomenon between a conventional non-differential operation inductor (i.e., a typical single end inductor) and its peripheral wire line often occurs. For example, the coupling phenomenon includes the coupling through the electromagnetic field (EM field) itself, the coupling through the coupling capacitor and the wire line, or the eddy current, which is formed on the substrate of the single-ended inductor and is coupled to the neighboring wire line. The electromagnetic field and the wire line coupling have the maximum influence.

FIG. 1A is a schematic view showing the coupling between a conventional single-ended inductor and a magnetic field of its peripheral wire line. In this drawing, the winding of a conventional single-ended inductor 100 can be derived according to Ampere's right-hand rule to obtain that a surrounding magnetic field is generated around the winding when the current flows through the single-ended inductor 100. As shown in FIG. 1A, when another wire line LO is present around the single-ended inductor 100, a coupling phenomenon between the surrounding magnetic field of the single-ended inductor 100 and the surrounding magnetic field of the peripheral wire line LO is caused to affect the signal quality of the wire line.

FIG. 1B is a schematic view showing a parasitic capacitor Cu in an area A of FIG. 1A. In this drawing, the single-ended inductor 100 is coupled with the wire line LO through the parasitic capacitor Cu to cause the circuit signal interference.

Therefore, how to eliminate the coupling phenomenon between the single-ended inductor and the peripheral wire line is a problem needed to be solved.

SUMMARY OF THE INVENTION

One of objects of the invention is to provide a single-ended inductor for eliminating the coupling problem between the single-ended inductor and the peripheral wire line winding, decreasing the signal interference and enhancing the signal quality.

A single-ended inductor comprises a first partial coil wound in a first direction; and a second partial coil wound in a second direction and adjoined the first partial coil; wherein, the second direction is opposite to the first direction to reduce the coupling of single-ended inductors and peripheral lines and reduce signal interference.

In the single-ended inductor according to the embodiment of the invention, the neighboring portions of the partial coils have reverse winding directions to eliminate the coupling phenomenon between the inductor and the peripheral wire line winding. Thus, the signal quality can be enhanced, and the conventional problem can be solved.

DETAILED DESCRIPTION OF THE INVENTION

Figure 2A:
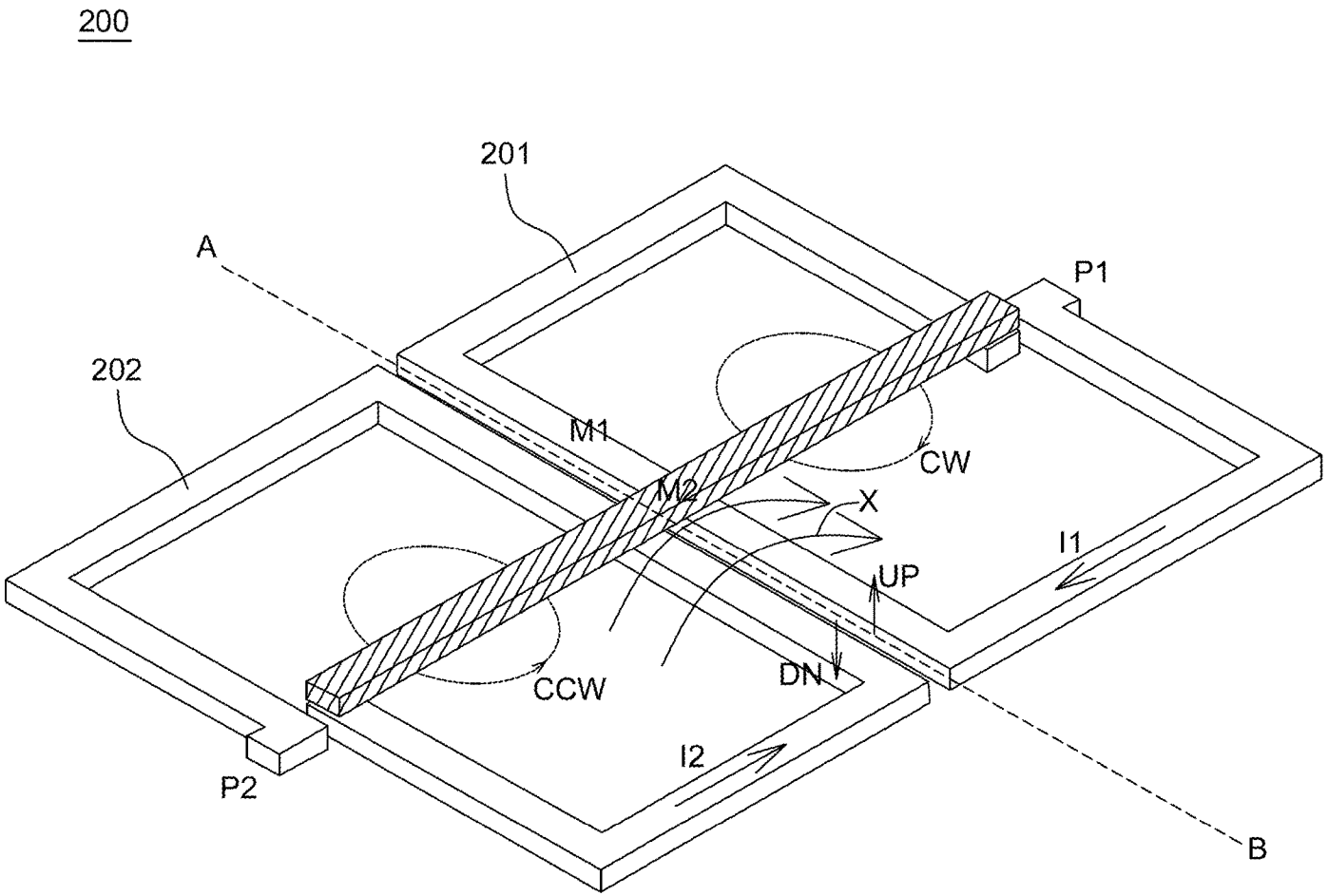
FIG. 2A is a schematic view showing a single-ended inductor according to an embodiment of the invention.

FIG. 2A is a schematic view showing a single-ended inductor according to an embodiment of the invention. In this drawing, the single-ended inductor 200 includes a plurality of partial coils 201 and 202. The first partial coil 201 is coupled to a first end P1 and disposed in a first metal layer M1. The second partial coil 202 is coupled to a second end P2 and disposed in the first metal layer M1. The first partial coil 201 is coupled to the second partial coil 202 through a wire of a second metal layer M2.

Furthermore, neighboring portions of the partial coils 201 and 202 have reverse winding directions and reverse current flowing directions. In the exemplary drawing, the first partial coil 201 is wound in a clockwise direction CW, and the second partial coil 202 is wound in a counterclockwise direction CCW. Thus, the winding directions of the neighboring positions of the first partial coil 201 are opposite to the second partial coil. In this manner, when the first current I1 flows thereinto from the first end P1, the first current I1 flows in the clockwise direction CW on the first partial coil 201 of the first metal layer M1 to generate an upward (UP) direction of the line of magnetic force at the position of the line segment AB according to Ampere's right-hand rule upon passing the position of the line segment AB. Next, the first current I1 flows into the second partial coil 202 along the wire of the second metal layer M2. Because the second partial coil 202 is wound in the counterclockwise direction CCW, the flowing direction of the first current I1 is set reversely to generate the second current I2 with the reverse direction. When the second current I2 flows through the line segment AB, a downward (DN) direction of the line of magnetic force is generated at the position of the line segment AB according to Ampere's right-hand rule. In this manner, the first partial coil 201 and the second partial coil 202 generate the eddy currents with the reverse directions on the substrate, and the eddy currents with the reverse directions can be cancelled out to achieve the effect of decreasing the eddy current of the substrate.

Figure 1A:
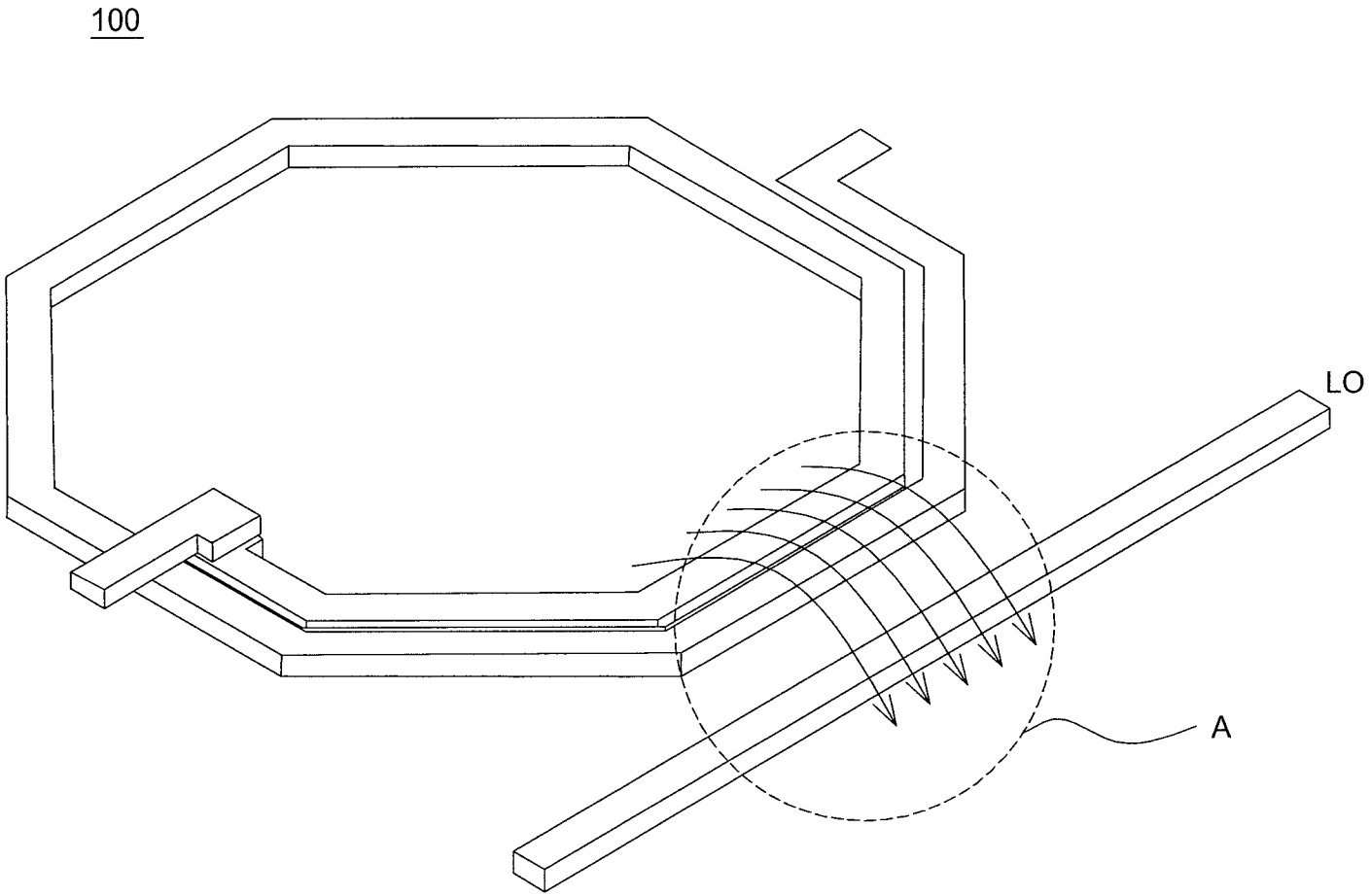
FIG. 1A (Prior art)
FIG. 1A is a schematic view showing the coupling between a conventional single-ended inductor and a magnetic field of its peripheral wire line.
Figure 1B:
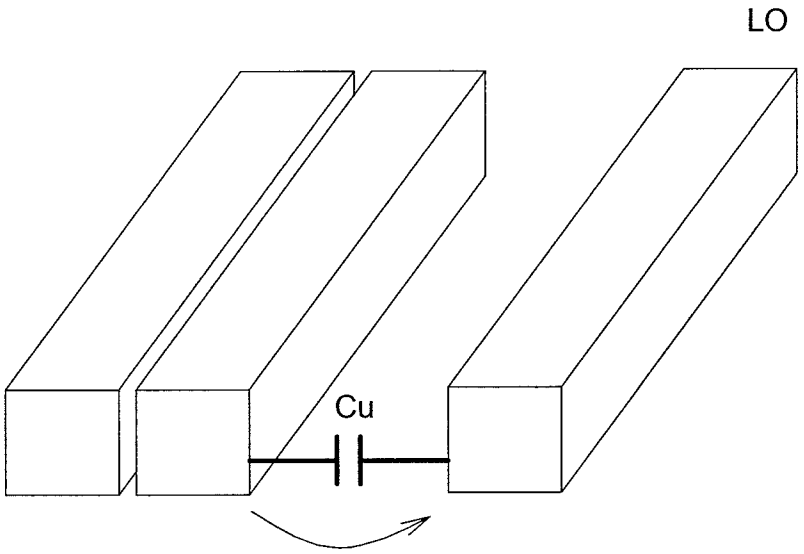
FIG. 1B (Prior art)
FIG. 1B is a schematic view showing a coupling capacitor between the conventional single-ended inductor and its peripheral wire line winding.

And the lines of magnetic forces inside the first partial coil 201 and the second partial coil 202 will loop between the first partial coil 201 and the second partial coil 202, as shown by the lines X of magnetic force in FIG. 2A, Thus, the magnetic field generated by the overall coils and coupling of the other wire lines as shown by FIG. 1A can be reduced.

Figure 2B:
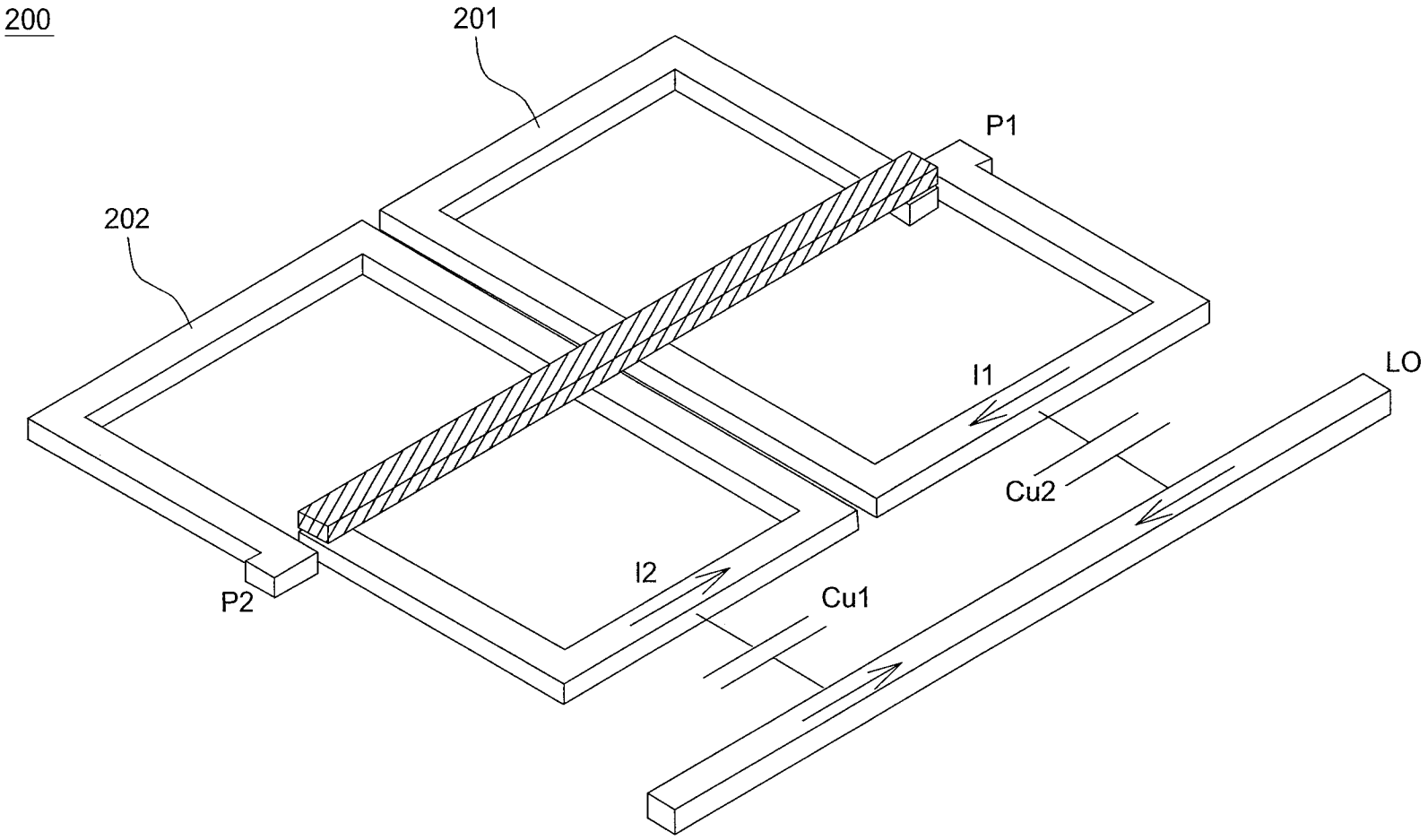
FIG. 2B is a schematic view showing a coupling capacitor between the single-ended inductor and the peripheral wire line winding according to the embodiment of the invention.

Furthermore, as shown in FIG. 2B, when there is another wire line LO passing the periphery of the single-ended inductor 200 of this embodiment, the caused electric fields have reverse directions because the currents I1 and 12 of the first partial coil 201 and the second partial coil 202 have reverse flowing directions. In addition, the magnetic field directions transferred to the wire line LO through the parasitic capacitors Cu1 and Cu2 are cancelled out due to the reverse directions, thereby reducing the interference problem of the wire line, enhancing the signal quality of the wire line, and solving the problem that the conventional single-ended inductor is coupled with the peripheral wire line winding to affect the signal quality of the circuit.

It is to be noted that the current input direction and the magnetic field direction of the single-ended inductor according to the embodiment of the invention are not restricted to those mentioned hereinabove, and may be arbitrarily adjusted and configured. In addition, the winding directions of the first partial area and the second partial area may also be arbitrarily adjusted.

Figure 2C:
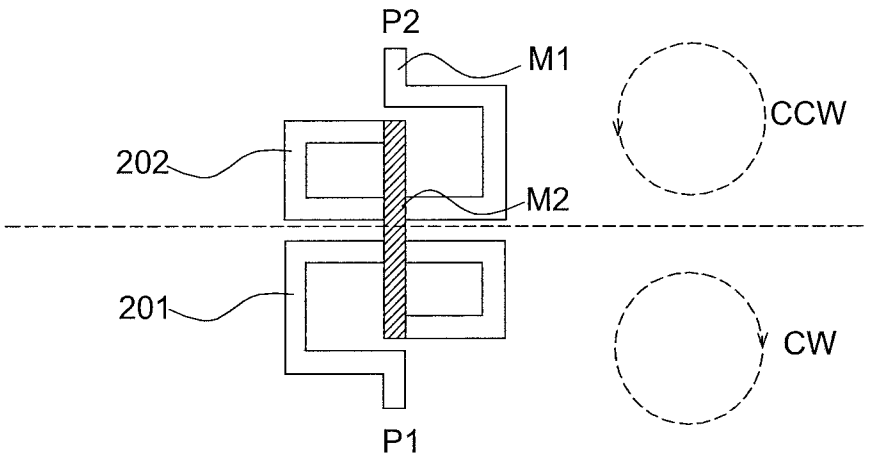
FIG. 2C is a top view showing the single-ended inductor of FIG. 2A of the invention.

FIG. 2C is a top view showing a single-ended inductor of FIG. 2A of the invention. As shown in FIG. 2C, it is assumed that the winding starts from the first end P1, that the winding direction of the first partial coil 201 is the clockwise direction CW, and that the winding direction of the second partial coil 202 is the counterclockwise direction CCW.

Figure 3:
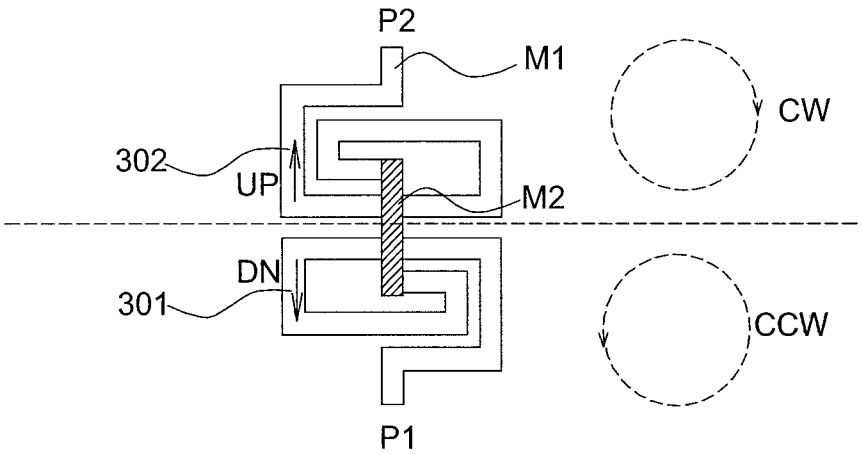
FIG. 3 is a top view showing a single-ended inductor according to another embodiment of the invention.

FIG. 3 is a top view showing a single-ended inductor according to another embodiment of the invention. The single-ended inductor 300 of FIG. 3 and the single-ended inductor 200 of FIG. 2C have reverse starting winding directions when viewed from the top. It is assumed that the winding starts from the first end P1, that the winding direction of the first partial coil 201 is the counterclockwise direction CCW, and that the winding direction of the second partial coil 202 is the clockwise direction CW. In addition, the first partial coil 201 is coupled to the second partial coil 202 through a wire of the second metal layer M2. In this manner, when the wire line passes the lateral side of the single-ended inductor 300, the single-ended inductor 300 generates the reverse magnetic field directions due to the reverse current directions of the two partial coils, so that the induced magnetic fields of the wire line passing the lateral side are cancelled out to enhance the signal quality.

Figure 4:
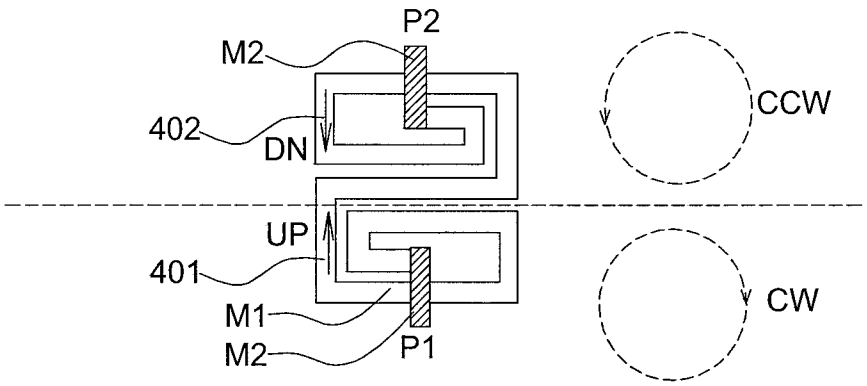
FIG. 4 is a top view showing a single-ended inductor according to another embodiment of the invention.

FIG. 4 is a top view showing a single-ended inductor according to another embodiment of the invention. A first partial coil 401 of the single-ended inductor 400 is coupled to a first end P1 through a wire of a second metal layer M2, and is disposed in a first metal layer M1. A second partial coil 402 of the single-ended inductor 400 is coupled to a second end P2 through the wire of the second metal layer M2, and is disposed in the first metal layer M1. The first partial coil 401 is coupled to the second partial coil 402 through the wire of the first metal layer M1. It is assumed that the winding starts from the first end P1, that the winding direction of the first partial coil 401 is the clockwise direction CW, and that the winding direction of the second partial coil 402 is the counterclockwise direction CCW. In this manner, when the wire line passes the lateral side of the single-ended inductor 400, the single-ended inductor 400 generates the reverse magnetic field directions due to the reverse current directions of the two partial coils, so that the induced magnetic fields of the wire line passing the lateral side are cancelled out to enhance the signal quality.

Figure 5:
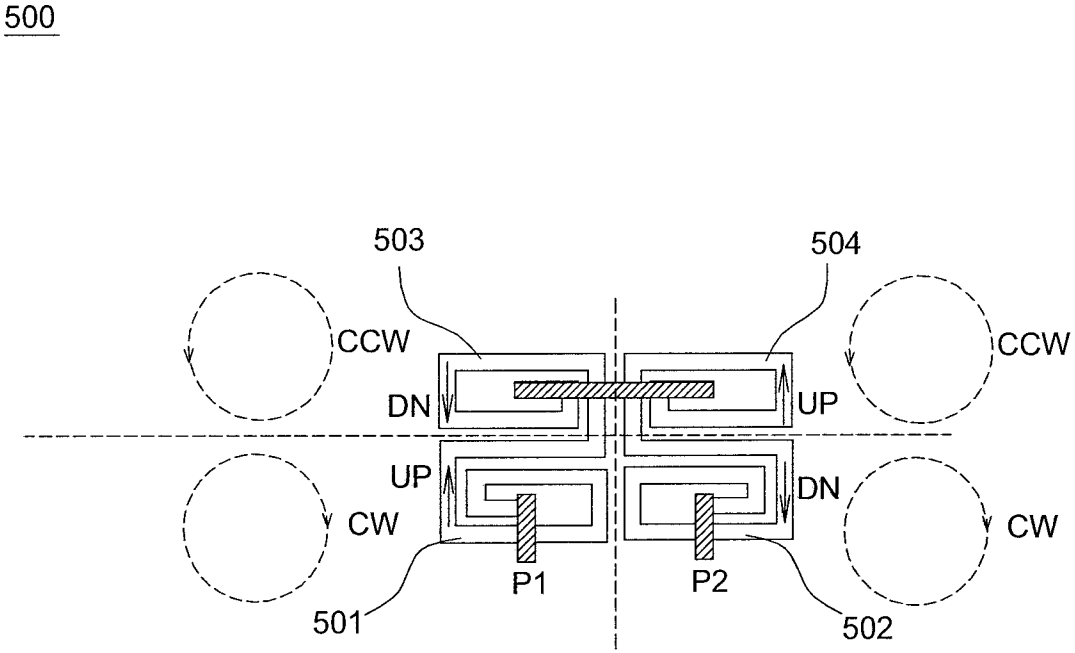
FIG. 5 is a top view showing a single-ended inductor according to another embodiment of the invention.

FIG. 5 is a top view showing a single-ended inductor according to another embodiment of the invention. A first partial coil 501 of the single-ended inductor 500 is coupled to a first end P1 through the wire of a second metal layer M2, and is disposed in a first metal layer M1. A second partial coil 502 of the single-ended inductor 500 is coupled to a second end P2 through the wire of the second metal layer M2, and is disposed in the first metal layer M1. A third partial coil 503 of the single-ended inductor 500 is disposed in the first metal layer M1, and has a first end coupled to the first partial coil 501. A fourth partial coil 504 of the single-ended inductor 500 is disposed in the first metal layer M1, and has one end coupled to the second partial coil 502, and the other end coupled to the other end of the third partial coil 503 through the wire of the second metal layer M2. It is assumed that the winding starts from the first end P1, that the winding direction of the first partial coil 501 is the clockwise direction CW, the winding direction of the third partial coil 503 is the counterclockwise direction CCW, that the winding direction of the fourth partial coil 504 is the counterclockwise direction CCW, and that the winding direction of the second partial coil 502 is the clockwise direction CW. In this manner, when the wire line passes the lateral side of the single-ended inductor 500, the single-ended inductor 500 generates the reverse magnetic field directions due to the reverse current directions of the two partial coils, so that the induced magnetic fields of the wire line passing the lateral side are cancelled out to enhance the signal quality.

Figure 6:
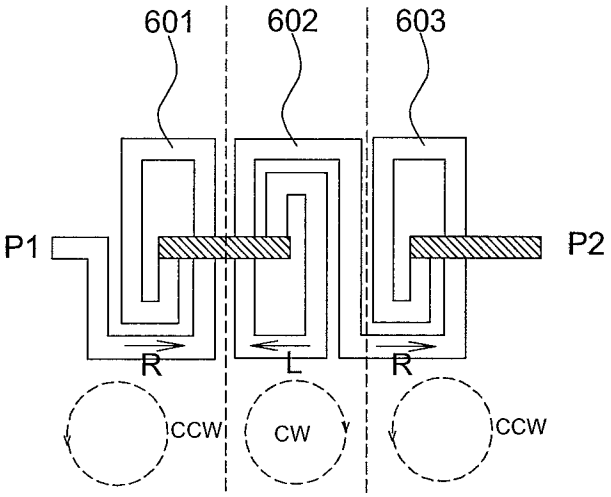
FIG. 6 is a top view showing a single-ended inductor according to another embodiment of the invention.

It is to be noted that the number of the partial coils of the single-ended inductor of the invention is not restricted to the even number, and there may also be an odd number of partial coils. FIG. 6 is a top view showing a single-ended inductor according to another embodiment of the invention. The single-ended inductor 600 includes three partial coils.

The winding methods of the first partial coil 601 and the second partial coil 602 of the single-ended inductor 600 are the same as those of the partial coil 301 and the second partial coil 302 of FIG. 3, and detailed descriptions thereof will be omitted. The third partial coil 603 has one end coupled to the other end of the second partial coil 602, and the other end of the third partial coil 603 is coupled to the second end P2, which is disposed in the second metal layer M2. It is assumed that the winding starts from the first end P1, that the first partial coil 601 is wound in the counterclockwise direction CCW, that the second partial coil 602 is wound in the clockwise direction CW, and that the third partial coil 603 is wound in the counterclockwise direction CCW. In this manner, when the wire line passes the lateral side of the single-ended inductor 600, the single-ended inductor 600 generates the reverse magnetic field directions because neighboring two of the three partial coils have reverse current directions (the current directions are sequentially the rightward direction R, the leftward direction L, and the rightward direction R from left to right of the drawing), so that the induced magnetic fields of the wire line passing the lateral side are cancelled out to enhance the signal quality.

Figure 7:
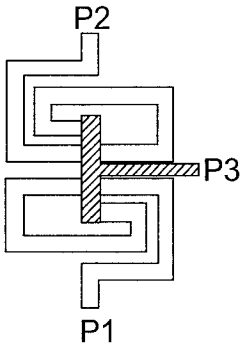
FIG. 7 is a top view showing a single-ended inductor according to another embodiment of the invention.

In addition, if there are other functional requirements, the design may also be arbitrarily adjusted. For example, the central tap may be added, as shown in FIG. 7, wherein a central tap P3 is added to the single-ended inductor 700.

In the single-ended inductor according to the embodiment of the invention embodiment, the neighboring portions of the partial coils have reverse winding directions to cancel out the coupling phenomenon between the inductor and the peripheral wire line winding, so that the signal quality can be enhanced and the conventional problem can be solved.

While the present invention has been described by way of examples and in terms of preferred embodiments, it is to be understood that the present invention is not limited thereto.

To the contrary, it is intended to cover various modifications. Therefore, the scope of the appended claims should be accorded the broadest interpretation so as to encompass all such modifications.

What is claimed is:

1. A single-ended inductor, comprising:

a first partial coil wound in a first direction; and a second partial coil wound in a second direction and adjoined the first partial coil;

wherein the second direction is opposite to the first direction; and a metal layer crosses over the first partial coil and the second partial coil;

neighboring portions of the first partial coil and the second partial coil have reverse winding directions of the first direction and the second direction; two first metal layers respectively have a first end and a second end; the first partial coil is coupled to the first end of one of the first metal layers, and the second partial coil is coupled to the second end of the other first metal layer; adjacent sidewalls are between to the two first metal layers; and the first end and the second end are not adjacent to the adjacent sidewalls;

the first partial coil is disposed in a first metal layer;

the second partial coil is disposed in the first metal layer; and the first partial coil is coupled to the second partial coil through a wire of a second metal layer;

a sidewall of the first metal layer is adjacent to a sidewall of another first metal layer without contacting; and the second metal layer crosses over the adjacent sidewalls;

wherein two inside terminals of the first metal layer are respectively surrounded by the two first metal layers; the two inside terminals respectively connect to the ends of the second metal layer; the first end and the second end of two first metal layers extend in opposite directions; and the second metal layer is above the location between the first end and the second end.

2. A single-ended inductor, comprising:

a first partial coil wound in a first direction; and a second partial coil wound in a second direction and adjoined the first partial coil;

wherein the second direction is opposite to the first direction; and a metal layer crosses over the first partial coil and the second partial coil;

neighboring portions of the first partial coil and the second partial coil have reverse winding directions of the first direction and the second direction;

two first metal layers respectively have a first end and a second end; the first partial coil is coupled to the first end of one of the first metal layer, and the second partial coil is coupled to the second end of the other first metal layer; adjacent sidewalls are between to the two first metal layers; and the first end and the second end are not adjacent to the adjacent sidewalls;

the first partial coil is disposed in a first metal layer;

the second partial coil is disposed in the first metal layer;

the first partial coil is coupled to the second partial coil through a wire of a second metal layer; and the first end and the second end are extended on a same axis.

3. The single-ended inductor according to claim 1, wherein:

the first end, the second end and two inside terminals are on a same axis.

* * * * *